United States Patent [19]

Hill

[11] Patent Number: 4,569,132

[45] Date of Patent: Feb. 11, 1986

[54] CUTTING TOOL WITH QUICK-ADJUSTING PIVOT ASSEMBLY AND ADJUSTING METHOD

[75] Inventor: Roy A. Hill, Statesboro, Ga.

[73] Assignee: Cooper Industries, Inc., Houston, Tex.

[21] Appl. No.: 554,672

[22] Filed: Nov. 23, 1983

[51] Int. Cl.[4] ..... B26B 13/26; B26B 13/28

[52] U.S. Cl. ..... 30/251; 30/267; 76/104 A

[58] Field of Search ..... 30/266, 267, 268, 269, 30/270, 252, 250, 257, 254, 251; 76/104 A

[56] References Cited

U.S. PATENT DOCUMENTS

| | | | |
|---|---|---|---|
| 1,227,333 | 5/1917 | Smith | 30/270 |
| 2,648,901 | 8/1953 | Northcutt | 30/257 X |
| 2,776,482 | 1/1957 | Hafekost | 30/270 X |
| 2,788,829 | 4/1957 | Edwards | 30/270 |
| 3,170,237 | 2/1965 | Weidauer | 30/268 |
| 3,289,296 | 12/1966 | Hedstrom et al. | 30/267 |
| 3,357,287 | 12/1967 | Wertepny | 81/322 |
| 3,453,651 | 7/1969 | Wertepny | 30/253 |
| 3,453,731 | 7/1969 | Wertepny | 30/267 |
| 3,587,173 | 6/1971 | Hexdall | 30/251 |
| 3,672,053 | 6/1972 | Wiss | 30/267 |
| 3,678,580 | 7/1972 | Duffy | 30/267 |
| 3,740,846 | 6/1973 | Duffy | 30/267 |
| 3,834,022 | 9/1974 | Students | 30/267 |
| 3,882,599 | 5/1975 | Plum | 30/270 |
| 4,055,891 | 11/1977 | Wick | 30/250 |
| 4,345,378 | 8/1982 | Pracht | 30/270 X |

FOREIGN PATENT DOCUMENTS

| | | | |
|---|---|---|---|
| 2638740 | 3/1978 | Fed. Rep. of Germany | 30/266 |

*Primary Examiner*—Jimmy C. Peters

*Attorney, Agent, or Firm*—Finnegan, Henderson, Farabow, Garrett & Dunner

[57] ABSTRACT

A compound-action scroll snip which is quickly and simply adjusted using a procedure amenable to automation. The snip includes a pair of pivotal blades in direct contact at the pivot point, and a pivot shaft with a head and a threaded end extending through round untapped holes in both blades. Two flat washers are located over the threaded end between one of the blades and a slotted-section locknut is threaded onto the threaded end. Proper adjustment of blade clearance is obtained by tightening the slotted-section locknut until a sudden increase in tightening torque occurs.

7 Claims, 7 Drawing Figures

STARTING

FULL LOCKED

CUTTING TOOL WITH QUICK-ADJUSTING PIVOT ASSEMBLY AND ADJUSTING METHOD

BACKGROUND OF THE INVENTION

The invention relates to hand tools and, more particularly, to cutting hand tools having a pair of pivotal members.

Pivotal member cutting tools such as shears, scissors, and snips are used to cut a variety of materials. Such tools require proper adjustment of the clearance between the pivotal members in order to insure proper operation of the tool and reduced cutting pressure. Adjustment is initially required during manufacture of the tool and, subsequently, in the field in order to compensate for wear, and to provide for better operation when cutting materials of different thickness. Field adjustment is also required as part of reassembly of the tool after sharpening.

Accurate adjustment is particularly important in heavy-duty compound-action tools, known as "aviation-type" snips, used to cut sheet metal. This is due to the very large forces exerted by the blades upon the material and the stresses to which the blades are subjected. Such tools are therefore provided with heavy large-diameter pivot shafts and a broad blade support area, that is, the area of the blades immediately adjacent to the pivot point.

Prior art aviation-type snips provided a threaded pivot shaft which extended through an untapped hole in one of the blades, and was threaded through a tapped hole in the other blade and secured by a locknut. Initial adjustment of such a tool during manufacture consisted of threading the shaft firmly into the tapped hole until the blades were tightly in contact, followed by a slight reverse threading operation of the shaft. A worker would then operate the tool in a normal manner to sense the "feel" of such operation. In a series of iterative procedures, the operator would alternately tighten or loosen the threaded shaft until the "feel" of the tool was correct, in his skilled judgment.

The locknut was then tightened on the shaft to preserve the adjustment. Such initial clearance adjustment was tedious and time-consuming, especially for aviation-type snips having an offset cutting line.

In order to insure proper operation of prior art tools, the tapping of the hole in the tool blade was required to be done with great precision. If the alignment of the tap in producing the threads in the hole was not correct, then blade misalignment would occur. This resulted not only in difficult operation of the tool but in rapid tool wear due to a reduced area of contact between the blades in the blade support area. This, in turn, often led to early failure of the tool.

Certain types of prior art light-duty compound-action tools employed a pair of stamped metal blades connected by a pivot assembly having a threaded shaft passing through untapped holes in each blade and secured by a spring-type lockwasher and a deformed-thread locknut. However, such tools did not readily allow accurate adjustment of blade clearance, and tended to lose adjustment during cutting operations.

In an effort to reduce manufacturing cost, it is desirable to automate as many steps in the manufacturing process as possible. However, the high degree of skill required in the adjustment procedure for prior art tools precluded the use of automation in this step. In addition, the cost of the taps, defective tools due to improperly tapped holes, and warranty costs due to premature failure caused by undetected misaligned tapped holes further added to the cost of such prior art tools.

It is therefore an object of the present invention to provide a cutting tool having a pair of pivotal members, the clearance of which can be quickly and accurately adjusted during manufacture using a process amenable to automation, and which will maintain adjustment when cutting heavy material.

It is an additional object of the invention to provide a cutting tool for which an accurate clearance adjustment procedure can be repeatedly carried out in the field.

It is a further object of the invention to provide a cutting tool having longer life and greater reliability, yet which can be manufactured at lower cost.

SUMMARY OF THE INVENTION

In accordance with a preferred embodiment of the present invention, there is provided a cutting tool comprising a pair of pivotal members each having an untapped hole extending through the respective pivotal member, a shaft extending through both of the holes and having a head at one end thereof and a threaded end at the other end thereof, a prevailing-torque fastener engaging the threaded end so as to draw the pivotal members together, and means for preventing the prevailing torque fastener from rotating with respect to the shaft due to rotational friction between the prevailing-torque fastener and the pivotal members. The rotation preventing means preferably comprises a plurality of washers disposed between the prevailing-torque fastener and the pivotal members.

BRIEF DESCRIPTION OF THE DRAWINGS

FIG. 4 is a top view of the slotted-section locknut shown in FIG. 3;

DESCRIPTION OF THE PREFERRED EMBODIMENT

Figure 1:
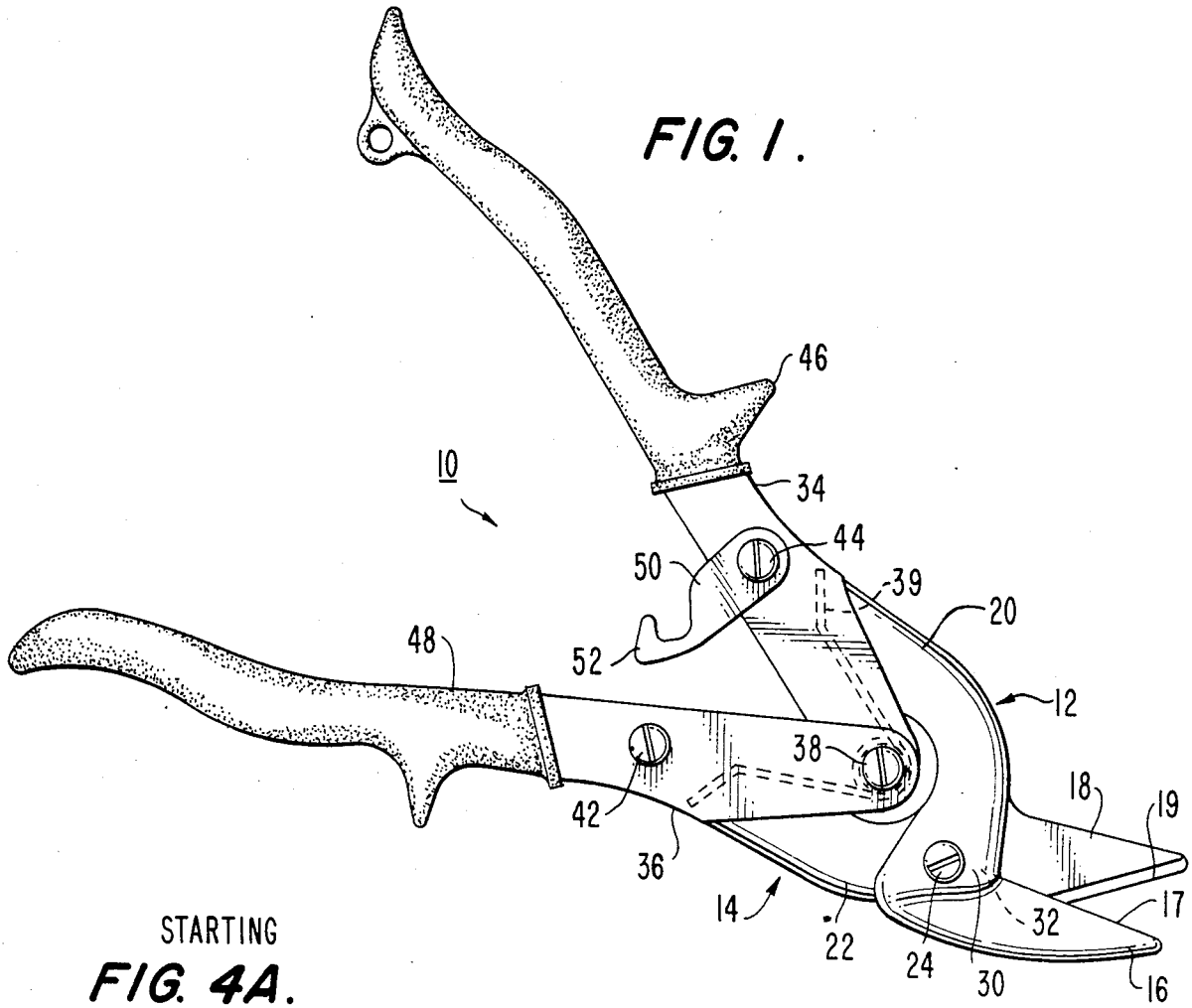
FIG. 1 is a side elevational view of a cutting tool constructed according to the teachings of the prior art with the tool shown in the open position.

FIG. 1 shows a cutting tool 10 constructed according to the prior art. Tool 10 is a heavy-duty compound action cutting tool known as "offset-cut aviation-type snips" used for cutting sheet metal of a thickness of, for example, 0.002 inches to 0.049 inches. Tool 10 is particularly useful for producing curving cuts in sheet metal by causing a portion of the material to scroll away from the plane of the remainder of the material, thereby allowing tool 10 to be readily maneuvered. Tool 10 includes first and second forged or cast pivotal blades 12 and 14, respectively, each having a cutting portion 16, 18, and a tang portion 20, 22. Blades 12 and 14 are pivotally connected by a pivot assembly 24 which extends through blade support portions 30 and 33 of blades 12 and 14, respectively. Blades 12 and 14 are in direct contact at mating surfaces 31 and 33 (FIG. 2) which form blade support areas. The surfaces 31 and 32 may be machined, precision cast, or formed by other precise manufacturing methods.

Figure 2:
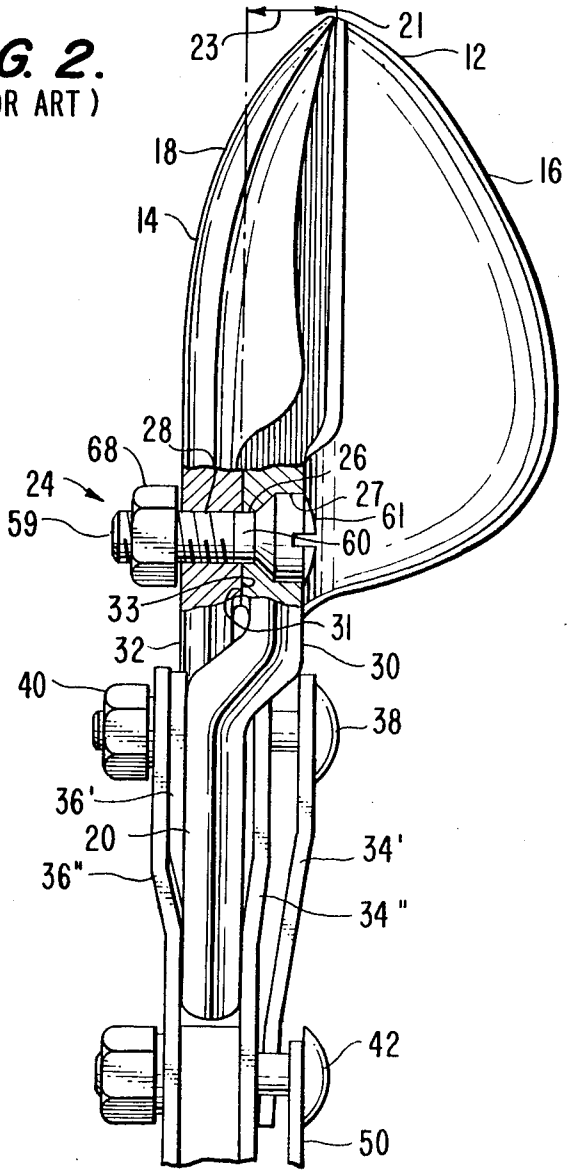
FIG. 2. (PRIOR ART)
FIG. 2 is a partial top view, partly in section, of the cutting tool shown in FIG. 1.

Tool 10 further includes a pair of handles 34 and 36 formed of stamped sheet metal. One end of each of handles 34 and 36 is bent to form upper extending members 34′, 36′ and lower extending members 34″ and 36″ (FIG. 2). A handle pivot screw 38 extends through upper extending members 34′, 36′ and through a coiled handle spring 39. Handle pivot screw 38 is passed through holes in lower extending members 34″ and 36″ and secured by a locknut 40.

Tang portions 20 and 22 are pivotally connected to handles 34 and 36 at points between the connected ends of handles 34 and 36 and the free ends of handles 34 and 36 by a pair of connecting screws 42 and 44 which are passed through holes in lower extending members 34″ and 36″, respectively and secured by locknuts. The ends of spring 39 are positioned inside of screws 42 and 44, as shown in FIG. 1, and are biased outwardly against tang portions 20 and 22 so that tool 10 automatically returns to the open position after being squeezed closed. The ends of handles 34 and 36 may be covered by a pair of molded plastic handle grips 46 and 48, respectively. A latch member 50 is pivotally connected to connecting screw 44 and includes a hook portion 52 which can be pivoted to engage an extending portion of connecting screw 42 to maintain tool 10 in the closed position for storage.

Each of cutting portions 16 and 18 has a cutting edge 17 and 19, respectively, machined therein. As can be seen in FIG. 2, cutting edges 17 and 19 provide a cutting line 21 which is parallel to and offset from the plane of contact of blades 12 and 14 in the area surrounding holes 26 and 28. The offset is indicated by arrow 23. As is well-known in the art, the offset cutting line provided by tool 10 allows the material cut away from the main workpiece to scroll up and out of the line of action of the tool, thus permitting maneuvering of the tool to facilitate complex cutting patterns.

Referring now particularly to FIG. 2, pivot assembly 24 of the prior art comprises a threaded pivot shaft 60 which extends through a round untapped counterbored hole 26 in blade 12. A threaded end 59 of shaft 60 is threaded into a round hole 28 of blade 14 which is tapped with threads corresponding to the threads of the pivot shaft 60. A head 61 of shaft 60 is seated against a shoulder 27 of hole 26.

The entire pivot assembly 24 is secured by a thread-deforming locknut 68. When the threads of pivot shaft 60 are engaged by thread-deforming locknut 68, they are deformed in a manner so as to secure the thread-deforming locknut 68 in the desired position, thereby maintaining the tightness of pivot assembly 24, which, in turn, maintains the alignment of blades 12 and 14.

It is important that tapped hole 28 be formed with great precision, as stated previously, so that interior mating surfaces 31 and 33 which form the blade support areas of the blade support portions 30 and 32 are in correct alignment. If the threads of hole 28 are even slightly misaligned, then mating surfaces 31 and 33 are not completely parallel, which results in a smaller blade support area. This, in turn, increases the stress on blade support areas 31 and 33, causing rapid wear. In addition, if the threads of tapped hole 28 are not precisely machined, cutting edges 17 and 19 of the cutting portions 16 and 18 are similarly misaligned. This results in poor cutting performance of tool 10.

Figure 3:
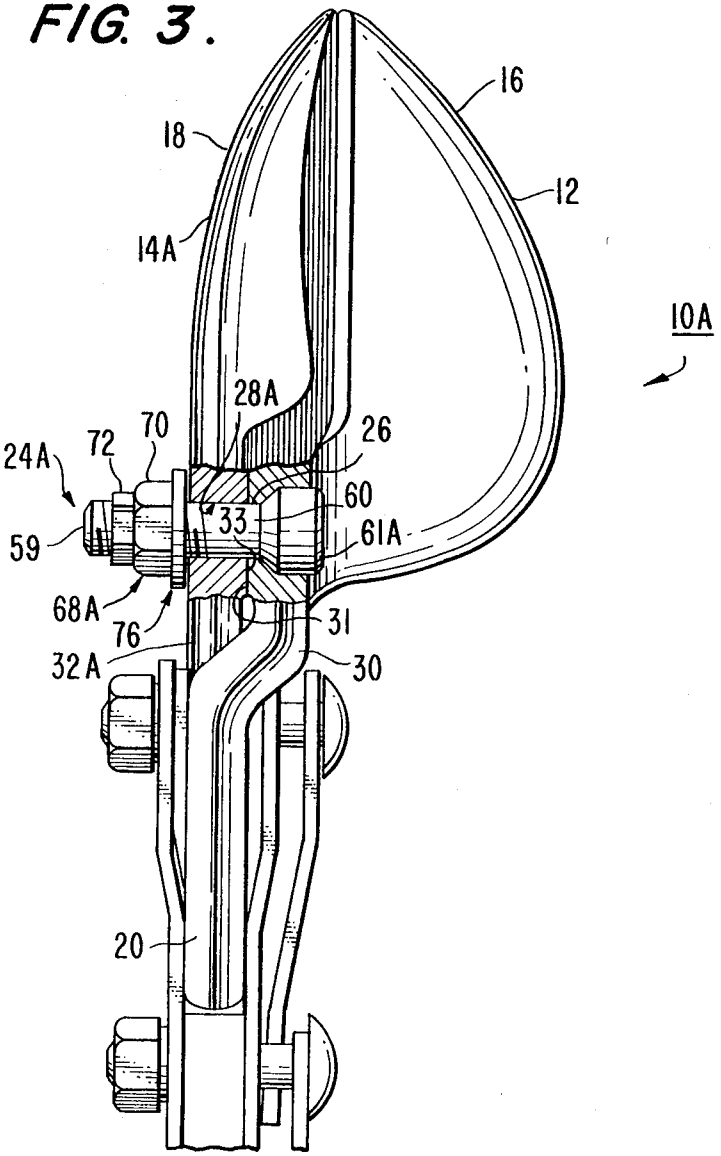
FIG. 3 is a partial top view, partly in section, of a cutting tool embodying the present invention.

FIG. 3 shows a cutting tool 10A embodying the present invention. Components of tool 10A which are substantially identical to those of prior art tool 10 are identified by identical reference numerals, while components of tool 10A which are different from, but similar to, components of prior art tool 10 are identified by the suffix "A". As can be seen in FIG. 3, hole 26 in blade support portion 30 of blade 12 is round and untapped as in the prior art. However, round hole 28A of blade support portion 32A of blade 14A is also untapped, unlike tapped hole 28 in prior art tool 10. The diameter of untapped holes 26 and 28A is 0.002–0.003 inches larger than the diameter of pivot shaft 60, to form a clearance fit. Pivot shaft 60 is thus essentially in direct contact with the walls of holes 26 and 28A and is rotatable therein. As can be further seen in FIG. 3, pivot assembly 24A includes a prevailing torque locknut such as a conventional slotted-section locknut 68A. A prevailing torque locknut is a fastener which spins freely at first on a threaded shaft then must be wrenched to the desired position. Such locknuts will provide locking action even when no load is being applied to them in an axial direction with respect to the shaft.

Figure 4A:
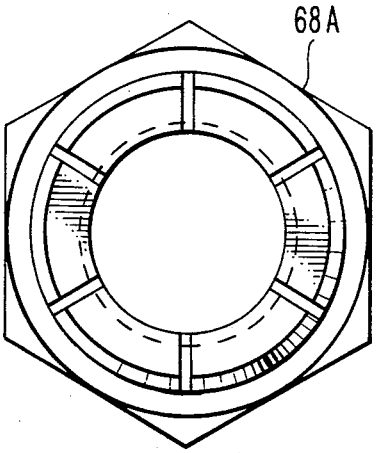
FIG. 4A is a top view of the prevailing-torque fastener shown in FIG. 3, with the fastener shown in the starting position.
Figure 4B:
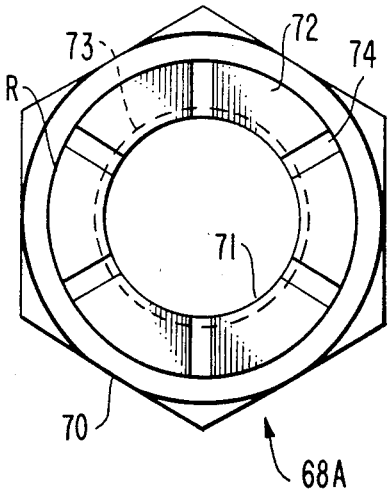
FIG. 4B is a view similar to FIG. 4A, with the fastener shown in the full locked position.
Figure 5:
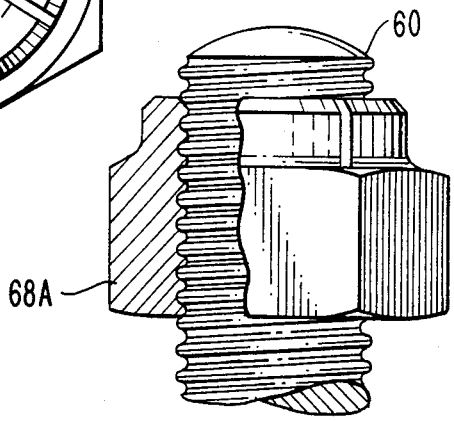
FIG. 5 is a side view, partly in section, of the prevailing torque fastener shown in FIG. 4B.

Slotted-section locknut 68A is a non-thread deforming prevailing torque fastener which includes a solid body portion 70 and an upper slotted section 72. As can be seen more clearly in FIG. 4, the threaded inner diameter 71 of slotted section 72 is slightly smaller than the threaded inner diameter 73 of bottom portion 70. Slotted section 72 further includes slots 74 cut therein. When slotted-section locknut 68A is threaded onto pivot shaft 60, slotted portion 72 is slightly stressed to grip the threads of pivot shaft 60. However, since the threads of slotted portions 72 are of the same pitch as the threads of pivot shaft 60, no thread deformation occurs.

Pivot assembly 24A further includes means for preventing the prevailing torque locknut (slotted-section locknut 68A) from rotating with respect to pivot shaft 60 due to rotational friction between slotted-section locknut 68A and pivotal member 14A. In the preferred embodiment, such means include two flat washers 76 disposed upon pivot shaft 60 between the slotted-section locknut 68A and the exterior surface of the blade support portion 32A of blade 14A. The two flat washers 76 prevent rotation of slotted-section locknut 68A with respect to pivot shaft 60 by reducing friction between pivotal member 14A and slotted-section locknut 68A and thus reducing torque transmission there-between during normal operation of tool 10A.

As previously described, it is important that tool 10A be adjustable such that proper clearance between cutting edges 17 and 19 (FIG. 1) can be established for a given thickness of material to be cut. The process for obtaining this adjustment during manufacture of tool 10A will now be described. After pivot shaft 60 is inserted through holes 26 and 28A and washers 76, slotted-section locknut 68A engages threaded end 59 of pivot shaft 60. Slotted-section locknut 68A is tightened against washers 76 until blades 12 and 14A are drawn together in direct contact at blade support areas 31 and 33, and a sudden increase in tightening torque is noted. This sudden increase in torque produced during the tightening of slotted-section locknut 68A on threaded end 59 of pivot shaft 60 corresponds to the proper blade clearance adjustment position of blades 12 and 14A.

Initial adjustment following assembly is thus accomplished with a simple non-iterative process. Since shaft 60 can rotate within both of holes 26 and 28A, proper adjustment can be maintained over extended operation of tool 10.

Slotted-section locknut 68A does not deform threads of pivot shaft 60. Therefore, the adjustment procedure can be repeatedly carried out in the field without substantial loss of locking capability of slotted-section locknut 68A. If the ability to perform field adjustment on multiple occasions is not important in a particular application, then other types of prevailing-torque fasteners, such as deformed-thread locknuts (not shown), could be used.

Proper adjustment of the clearance between blades 12 and 14A of offset-cut aviation-type snips is particularly critical. It has been determined that the present invention is therefore especially suitable to provide such critical adjustment in a simple and readily repeatable manner. However, the invention also provides similar beneficial results for standard in-line aviation-type snips, and for other types of cutting tools having pivotal members.

Although tool 10A is shown to include a slotted-head pivot shaft 60 having a slope-shouldered hex-keyed head 61A countersunk below the exterior surface of blade support portion 30, other types of pivot shafts 60 could, be provided For example, a slotted-head shaft such as shaft 60 could be used. Alternatively, a standard hex-head screw can be used with a straight-sided untapped hole rather than the counterbored hole 26 shown in FIG. 3.

In certain applications it may be desirable to provide a washer over pivot shaft 60 between pivotal members 12 and 14A. Blade support areas 31 and 33 would not then be in contact.

The elimination of tapped holes in pivot assembly 24A of tool 10A provides superior operation over tools of the prior art by assuring better alignment of the blades of the tool. This, in turn, results in better cutting performance over a longer period of time. In a test conducted between prior art tools as shown in FIGS. 1 and 2, and a tool embodying the principles of the present invention as shown in FIG. 3, the prior art tools could perform no more than 113,000 cuts prior to failure. The tool shown in FIG. 3, similar to the tool shown in FIGS. 1 and 2 except that it embodies the principles of the present invention, successfully completed more than 275,000 cuts before failure. In each case, the failure mode was excessive wear at the tips of the blades.

The adjustment procedure obtainable with the present invention is much simpler than that required by prior art devices, and includes an objective criterion of proper adjustment. That is, proper adjustment is detected upon the occurrence of a sudden increase in torque when tightening slotted-section locknut 68A on the threaded end 59 of pivot shaft 60. Such adjustment procedure is especially suitable for automation, in contrast to the repetitive adjustment procedure required by prior art devices which called for the exercise of a high degree of skill from an experienced worker. Accordingly, the adjustment procedure of the present invention provides substantially reduced manufacturing costs over the prior art. Furthermore, the cost of taps to produce the tapped holes of the prior art is eliminated. In addition, it is possible to eliminate the scrap cost associated with defective products having misalignment of the tapped holes. Additional cost reductions are possible by eliminating the warranty cost associated with tools which prematurely fail in the field due to misaligned tapped holes.

It can be seen therefore that the present invention provides a cutting tool having a pair of pivotal members which can be quickly and accurately adjusted during manufacture using a process amenable to automation. Furthermore, the invention provides a cutting tool for which an accurate adjustment procedure can be repeatedly carried out in the field. The invention additionally provides a tool having a longer life and greater reliability which can be manufactured at lower cost.

It will be apparent to those of ordinary skill in the art that various modifications and variations can be made to the above-described embodiments of the invention without departing from the scope of the appended claims and their equivalents.

What is claimed is:

1. A cutting tool comprising:

a pair of pivotal members each having a round untapped hole extending through said pivotal member, at least one of said pivotal members comprising a cutting element;

a shaft extending through both of said holes and having a head at one end and a threaded end at the other end thereof;

a prevailing-torque locknut engaging said threaded end so as to draw said pivotal members together; and a plurality of flat washers disposed between said prevailing-torque locknut and a surface of said pivotal members, said washers maintaining a constant spacing between said prevailing-torque locknut and said pivotal members.

2. A tool as recited in claim 1 wherein said prevailing-torque locknut comprises a slotted-section locknut.

3. A tool as recited in claim 1 wherein:

said shaft forms a clearance fit with the walls of both of said holes, said pivotal members are in direct contact in the area surrounding said holes; and said shaft is in contact with the walls of both of said holes.

4. A compound action cutting tool comprising:

first and second pivotal blades, each of said blades comprising a cutting portion, a tang portion, and a blade support portion between said cutting portion and said tang portion, each of said blade support portions having a blade support area and a round untapped hole formed therethrough;

first and second handles pivotally connected together at one end and pivotally connected to said first and second tang portions, respectively, at positions between the connected ends of said first and second handles and the free ends thereof;

a pivot assembly, said pivot assembly comprising a pivot shaft extending through said holes and having a head at one end thereof and a threaded end at the other end thereof, a prevailing-torque locknut engaging said threaded end so as to draw said first and second pivotal blades together and;

a plurality of washers disposed on said pivot shaft between said prevailing-torque locknut and one of said pivotal blades, said washers maintaining a constant spacing between said prevailing-torque locknut and one of said pivotal blades.

5. A tool as recited in claim 4 wherein said prevailing-torque locknut comprises a slotted section nut.

6. A tool as recited in claim 4 wherein said pivot shaft is in contact with the walls of both of said holes and said blade support areas are in direct contact.

7. A method for adjusting the blade clearance of a tool having a pair of pivotal blades, comprising the steps of:

inserting a pivot shaft having a head at one end and a threaded portion at the other end through a round untapped hole in each of the blades;

placing a device for reducing friction over the threaded portion end;

threading a prevailing-torque locknut on the threaded portion end; and tightening the prevailing-torque locknut until a sudden increase in torque is required to further tighten the prevailing-torque locknut.

* * * * *